US008584630B2

(12) United States Patent
Siefker

(10) Patent No.: US 8,584,630 B2
(45) Date of Patent: Nov. 19, 2013

(54) SWITCHABLE ROLLER FINGER FOLLOWER ASSEMBLY

(75) Inventor: Kirk Siefker, Pleasant Ridge, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 425 days.

(21) Appl. No.: 13/072,457

(22) Filed: Mar. 25, 2011

(65) Prior Publication Data

US 2011/0239968 A1 Oct. 6, 2011

Related U.S. Application Data

(60) Provisional application No. 61/318,932, filed on Mar. 30, 2010.

(51) Int. Cl.
*F01L 1/24* (2006.01)

(52) U.S. Cl.
USPC ..... 123/90.16; 123/90.27; 123/90.39; 123/90.44; 123/90.45

(58) Field of Classification Search
USPC ..... 123/90.16, 90.27, 90.39, 90.41, 90.43, 123/90.44, 90.45, 90.46
See application file for complete search history.

(56) References Cited

U.S. PATENT DOCUMENTS

| | | | | |
|---|---|---|---|---|
| 6,467,445 | B1 * | 10/2002 | Harris | 123/90.16 |
| 7,302,924 | B2 * | 12/2007 | Roerig et al. | 123/90.39 |
| 8,033,260 | B2 * | 10/2011 | Reinecke-Murmann et al. | 123/90.39 |
| 2001/0023675 | A1 * | 9/2001 | Lee et al. | 123/90.18 |
| 2001/0027765 | A1 * | 10/2001 | Hendriksma et al. | 123/90.44 |
| 2003/0230270 | A1 * | 12/2003 | Seitz | 123/90.44 |
| 2004/0206324 | A1 * | 10/2004 | Artmann | 123/90.39 |
| 2005/0132990 | A1 * | 6/2005 | Haas et al. | 123/90.16 |
| 2005/0247279 | A1 * | 11/2005 | Rorig et al. | 123/90.16 |
| 2007/0006837 | A1 * | 1/2007 | Seitz et al. | 123/90.39 |
| 2008/0127917 | A1 * | 6/2008 | Riley et al. | 123/90.11 |
| 2008/0245326 | A1 * | 10/2008 | Gemein | 123/90.16 |
| 2008/0245330 | A1 * | 10/2008 | Deierlein et al. | 123/90.39 |
| 2008/0295789 | A1 * | 12/2008 | Manther et al. | 123/90.45 |
| 2009/0000584 | A1 * | 1/2009 | Rorig et al. | 123/90.39 |
| 2009/0064954 | A1 * | 3/2009 | Manther | 123/90.44 |
| 2009/0217895 | A1 * | 9/2009 | Spath et al. | 123/90.16 |
| 2010/0236507 | A1 * | 9/2010 | Kang et al. | 123/90.44 |

* cited by examiner

*Primary Examiner* — Kenneth Bomberg
*Assistant Examiner* — Jorge Leon, Jr.
(74) *Attorney, Agent, or Firm* — Lucas & Mercanti, LLP

(57) ABSTRACT

A switchable roller finger follower for a valvetrain of an internal combustion engine. The switchable roller finger follower includes an elongated body, a cam follower, a locking pin assembly, lost motion springs and a shuttle pad assembly moving horizontally. The locking pin assembly includes a locking pin and hydraulic fluid supply channel, selectively locking and unlocking the shuttle pad assembly, allowing either a high lift or low lift profile to achieve contact with pre-determined profiles of a multi-lobe camshaft which, in turn, provides low lift or high lift operation of an associated gas exchange valve.

15 Claims, 2 Drawing Sheets

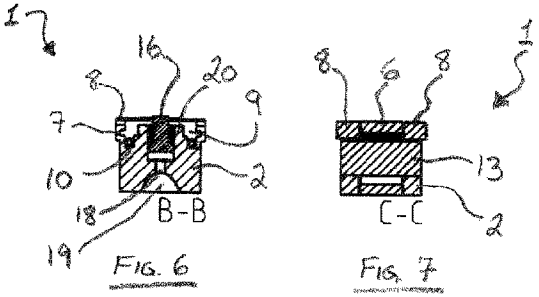
FIG. 6
FIG. 7
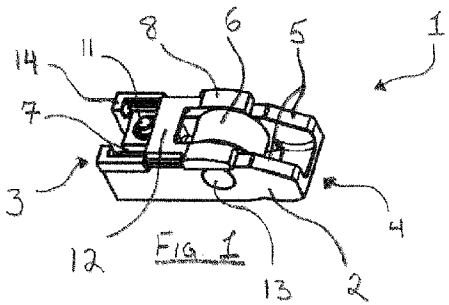
FIG. 1
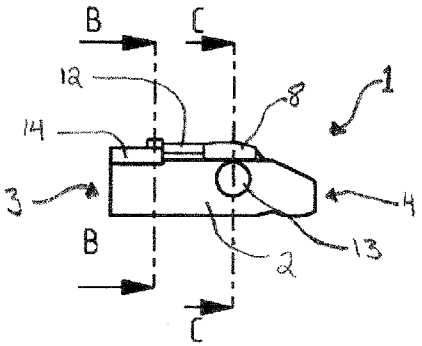
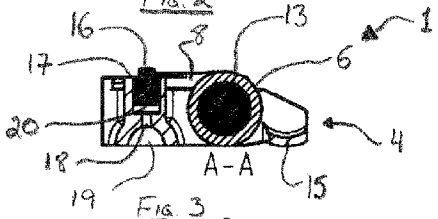
FIG. 2
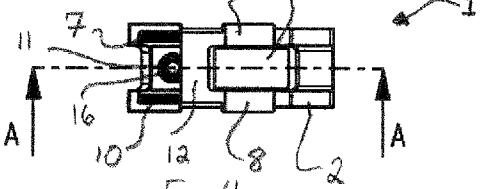
FIG. 3
FIG. 4
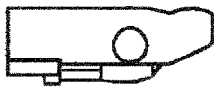
FIG. 5
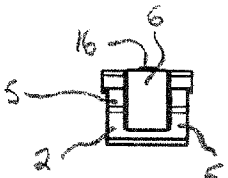
FIG. 8

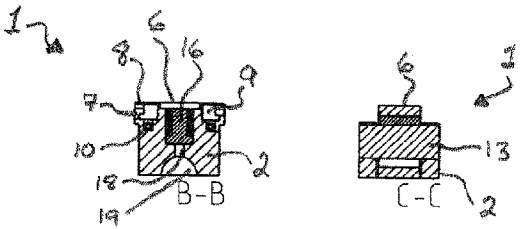
FIG. 15
FIG. 14
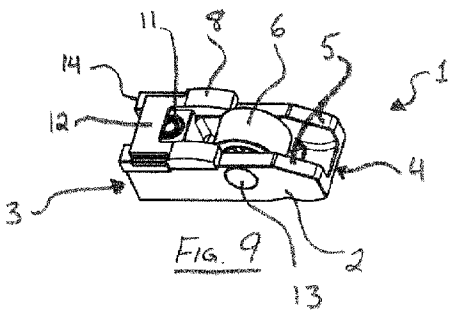
FIG. 9
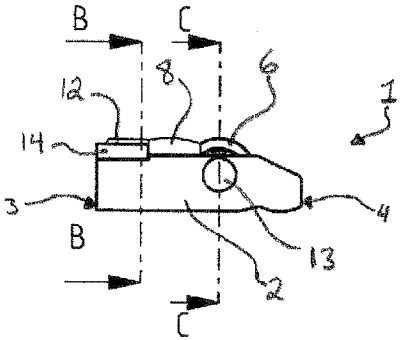
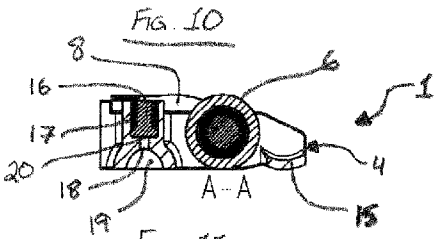
FIG. 10
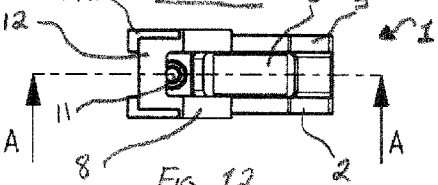
FIG. 11
FIG. 12
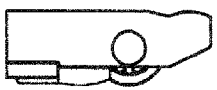
FIG. 13
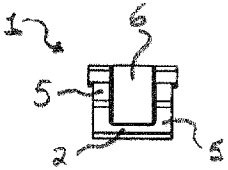
FIG. 16

SWITCHABLE ROLLER FINGER FOLLOWER ASSEMBLY

This application claims the priority of U.S. 61/318,932 filed Mar. 30, 2010, which is incorporated by reference herein.

TECHNICAL FIELD

The present invention relates generally to a roller finger follower assembly for a valvetrain of an internal combustion engine, and, more particularly, to a switchable roller finger follower assembly.

BACKGROUND

Historically, valve lift profiles were fixed relative to the angular position of the engine crankshaft and the amount of lift imparted to each valve was also fixed. This adversely limited the performance and efficiency of internal combustion engines, and, in turn, had a negative impact on emissions. by having fixed lift profiles inherent compromises must be made between low and high speed operation, also necessitating the use of throttling devices in the internal combustion engine that introduce their own inefficiencies.

To combat these inefficiencies, modern internal combustion engines utilize several methods or devices to vary the valve lift profile to better manage the air flow into and out of the internal combustion engine cylinder. Among these are a group of devices intended to vary lift profiles by selectively switching between two or more different lift profiles as needed during operation. To date, this has been accomplished by the inclusion in a valvetrain of various devices, either alone or in unison with other devices, such as cam profile switching roller finger followers.

Such cam profile switching roller finger followers are known in the art and generally require relatively large envelope space with a related large mass moment of inertia. In a small and tightly packaged valvetrain, such space requirements add mass and are thus counter to providing higher performance and efficiency.

Typically, known roller finger followers have a high lift mode, a low lift mode and sometimes a no lift mode. They may comprise an outer elongated body, one end of which mates with a valve stem and operates on the valve stem, and a second end which is in contact with a hydraulic lash adjuster. An inner elongated body may be centrally located in the outer elongated body, housing a cam follower that is operated on by the earn so as to provide motion to the finger follower. The inner elongated body may have two modes, a locked mode and an unlocked mode. A latching or locking mechanism is incorporated into the roller finger follower assembly and is used to lock the inner elongated body in a stationary position. When the inner elongated body is locked in a stationary position, contact by the cam of the camshaft forces movement of the finger follower which translates into movement of the valve through the valve stem. When the locking pin or latch is released, the inner elongated body may move freely relative to the outer elongated body and no movement is translated to the valve of the engine. Typically, the inner elongated body pivots at one end, where it is attached to the outer elongated body, to move freely.

In order to maintain contact between the cam and the cam follower during the unlocked periods, a lost motion spring is employed. A typical lost motion spring is either helical or torsional.

SUMMARY OF THE INVENTION

A new design for a switchable roller finger follower assembly for one gas exchange valve in a valve train for an internal combustion engine has now been discovered. In one example embodiment of the invention, the assembly comprises an elongated body, a cam follower, and at least one slider pad that may be locked into position by a locking mechanism. The slider pads in contact with an associated cam of a camshaft, operating a high lift mode of an associated valve of an internal combustion engine when locked into position, and effecting lost motion movement against at least one lost motion spring when in an unlocked position. When the at least one slider pad is unlocked, low lift operation of an associated valve is effected when the cam lobe of the camshaft contacts the cam follower rather than the at least one slider pad. In this example embodiment, a multi-lobe camshaft is preferred.

A further example embodiment of the invention in mechanical valvetrains employs a mechanical lash adjuster element, the mechanical lash adjuster element being adjustable to achieve targeted valvetrain lash. The mechanical lash adjuster element may be replaced with minimal modification with a hydraulic lash adjuster.

A method for operating a roller finger follower, such as described above, also is provided.

BRIEF DESCRIPTION OF DRAWINGS

The above mentioned and other features and advantages of the embodiments described herein, and the manner of attaining them, will become apparent and be better understood by reference to the following description of at least one example embodiment in conjunction with the accompanying drawings. A brief description of those drawings now follows.

FIG. 1 is a perspective view of the switchable roller finger follower assembly in a locked position, according to one example embodiment of the invention.

FIG. 2. is a side view of the switchable roller finger follower assembly of FIG. 1.

FIG. 3 is a cross sectional view of the switchable roller finger follower assembly of FIG. 1 taken along line A-A of FIG. 4.

FIG. 4 is a top view of the switchable roller finger follower assembly of FIG. 1.

FIG. 5 is a upside down side view of the switchable roller finger follower assembly of FIG. 1

FIG. 6 is a cross sectional view of the switchable roller finger follower assembly of FIG. 1, taken along line B-B of FIG. 2.

FIG. 7 is a cross sectional view of the switchable roller finger follower assembly of FIG. 1, taken along line C-C of FIG. 2

FIG. 8 is a front view of the switchable roller finger follower assembly of FIG. 1.

FIG. 9 is a perspective view of the switchable roller finger follower assembly in an unlocked position, according to one example embodiment of the invention.

FIG. 10. is a side view of the switchable roller finger follower assembly of FIG. 9.

FIG. 11 is a cross sectional view of the switchable roller finger follower assembly of FIG. 9, taken along line A-A of FIG. 12.

FIG. 12 is a top view of the switchable roller finger follower assembly of FIG. 9.

FIG. 13 is a upside down side view of the switchable roller finger follower assembly of FIG. 9.

FIG. 14 is a cross sectional view of the switchable roller finger follower assembly of FIG. 9, taken along line B-B of FIG. 10.

FIG. 15 is a cross sectional view of the switchable roller finger follower assembly of FIG. 9, taken along line C-C of FIG. 10.

FIG. 16 is a front view of the switchable roller finger follower assembly of FIG. 9.

DETAILED DESCRIPTION OF THE INVENTION

Identically labeled elements appearing in different ones of the figures refer to the same elements but may not be referenced in the description for all figures. The exemplification set out herein illustrates at least one embodiment, in at least one form, and such exemplification is not to be construed as limiting the scope of the claims in any manner.

FIG. 1 shows a perspective view of a switchable roller finger follower 1 in a locked position constructed according to an example embodiment of the invention. Switchable roller finger follower 1 comprises an elongated body 2 having a lash adjuster end 3, a valve stem end 4 and at least two outer elongated side walls 5 extending between the lash adjuster end and the valve stem end. A cam follower 6 is positioned in the elongated body mounted between the two outer elongated side walls 5, on mounting pin 13. A vertical slot 7 is positioned on a top edge of the elongated body side walls. A horizontally moveable lockable shuttle pad 8 is positioned on the side wall 5 of the elongated body 2. The shuttle pad 8 has at least one downward extension arm 9 (see FIG. 6) extending into the vertical slot 7 for guiding and limiting the horizontal movement of the shuttle pad 8 on the outer elongated side wall 5. At least one lost motion spring 10 (see FIG. 6) is positioned in the vertical slot 7 and is in contact with the extension arms 9 of the shuttle pad 8. Spring 10 horizontally urges the shuttle pad 8 toward the cam follower 6. At least one locking pin assembly 11 operates to selectively lock the pad 8 in locked position to effect one or more selected ones of plural lift operations. Although two shuttle pads 8 connected at the shuttle pad base 12 are shown, any number of shuttle pads 8 are anticipated by the invention. Also shown is an optional vertically extending horizontal guide wall 14

FIG. 2 is a side view of the switchable roller finger follower 1 in locked position, showing elongated body 2, having lash adjuster end 3 and valve end 4. Shuttle pad 8 is connected to shuttle pad base 12. Horizontal guide wall 14 guides the horizontal movement of and acts as a stop for pad 8.

FIG. 3 is a cross sectional view of the switchable roller finger follower 1, taken along line A-A of FIG. 4. Valve stem seat 15 is in valve end 4. Cam follower 6 is mounted on cam follower mounting pin 13. Shuttle pad base 12 is in contact with locking pin assembly 11. Locking pin assembly 11 locks the shuttle pads 8 (not shown) in position adjacent the cam follower 6. Locking pin assembly 11, comprises locking pin 16, locking pin recess 17, and hydraulic supply channel 18. Hydraulic fluid may be supplied through an associated hydraulic lash adjuster (not shown) seated in lash adjuster seat 19 connected through hydraulic supply channel 18, or by other supply means wherein hydraulic supply channel 18 is located elsewhere through elongated body 2.

FIG. 4 is a top view of the switchable roller finger follower 1 in the locked position, showing elongated body 2, cam follower 6 and shuttle pads 8 connected with shuttle pad base 12. Locking pin 16 of locking pin assembly 11 is in contact with the shuttle pad base 12, and shuttle pad extension arms 9 (not shown) are seated in vertical slots 7. Lost motion springs 10 are positioned in slots 7 to support lost motion movement of the shuttle pads 8. In addition, guide walls 14 provide horizontal guidance when shuttle pads 8 are in the unlocked mode, effecting lost motion movement against lost motion springs 10. It is also contemplated by this invention that vertical slots 7 may be horizontal slots positioned in guide walls 14.

FIG. 5 is a upside down side view of the switchable roller finger follower 1 in the locked position, showing the same features as FIG. 2.

FIG. 6 is a cross sectional view of the switchable roller finger follower 1 in the locked position, taken along line B-B of FIG. 2, showing elongated body 2, with shuttle pads 8 thereon, shuttle pad extension arms 9 extending downwardly into vertical slots 7, in contact with lost motion springs 10, and locking pin assembly 11 in the locked position, comprising locking pin 16 in locking pin recess 17 vertically extended past the plane of the elongated body top surface so that it blocks rearward movement of the shuttle pads 8 by maintaining contact with the shuttle pad base 12. Locking pin 16 is pushed vertically upward by hydraulic fluid, often engine oil, supplied through a lash adjuster (not shown) seated in lash adjuster seat 19, through hydraulic supply channel 18 and contacting the wide pin base 20 of locking pin 16.

FIG. 7 is a cross sectional view of the switchable roller finger follower 1 in the locked position, taken along line C-C of FIG. 2, showing cam follower 6 mounted on cam follower mounting pin 13 in elongated body 2, and shuttle pads 8 in the locked position adjacent the cam follower 6.

FIG. 8 shows a front view of the switchable roller finger follower 1 in the locked position, taken from the valve end 4, showing cam follower 6, elongated body 2 with elongated body side walls 5 to either side of cam follower 6. A small portion of vertically extended locking pin 16 is visible over the top surface of cam follower 6.

FIG. 9 shows a perspective view of a switchable roller finger follower 1 in the unlocked position constructed according to an example embodiment of the invention. The features of switchable roller finger 1 are the same as shown in FIG. 1, however, locking pin 16 is no longer vertically extended. The hydraulic fluid having been exhausted through hydraulic supply channel 18, allowing rearward movement of shuttle pad base 12 with joined shuttle pads 8 in response to an external force caused by rotational contact from an associated cam lobe (not shown) of a cam shaft (not shown) of a valvetrain (not shown). In response to this force shuttle pads 8 and extension arms 9 (see FIG. 14) are pushed rearward in vertical slots 7. Extension arms 9 compress lost motion springs 10 (see FIG. 14). When force from the associated cam lobes (not shown) is removed, lost motion springs 10 return to an uncompressed state, pushing against extension arms 9, bringing extension arms 9 and associated shuttle pads 8 adjacent cam follower 6 back to the position shown in FIG. 1. Shuttle pad base 12 is not locked in the unlocked position, maintaining a portion of overlapping material over the top planar surface of locking pin 16.

FIG. 10 is a side view of switchable roller finger follower 1 in the unlocked position, similar to FIG. 9. Once again, shuttle pads 8 are shown in fully rearward position, with associated maximum compression of lost motion springs 10. Shuttle pad base 12 and shuttle pads 8 are not locked in this position, effecting lost motion movement in response to the external force from associated cam lobes (not shown) and the contrary force from lost motion springs 10 against extension arms 9.

FIG. 11 shows a cross sectional view of switchable roller finger follower 1, taken along line A-A of FIG. 12, showing all the features of FIG. 3, instead with hydraulic fluid exhausted through hydraulic fluid supply channel 18 and from locking pin recess 17, thus allowing locking pin 16 to retract into locking pin recess 17. With locking pin 16 in the unlocked position losing contact with shuttle pad base 12, shuttle pad base 12 is allowed to move rearward in response to an external force from associated cam lobes (not shown). Shuttle pads 8 are shown in a fully retracted position.

FIG. 12 is a top view of switchable roller finger follower 1 in the unlocked position, showing shuttle pads 8 in the retracted position similar to FIG. 9. In this view it is more clearly seen that shuttle pad base 12 overlaps the top planar surface of locking pin 16, thus preventing locking pin 16 from locking shuttle pads 8 in a fully rearward retracted position in the event hydraulic fluid is supplied to locking pin recess 17 and against locking pin base 20.

FIG. 13 is a upside down side view of switchable roller finger follower 1 in the unlocked position, showing the same features as FIG. 10.

FIG. 14 is a cross sectional view of switchable roller finger follower 1 in the unlocked position, taken along line B-B of FIG. 10, showing the features FIG. 6, instead with locking pin 16 fully retracted in the unlocked position. As locking pin base 12 is in the fully retracted unlocked position, the cross section is taken forward of locking pin base 12, making cam follower 6 visible. FIG. 7 is a cross sectional view of the switchable roller finger follower 1 in the locked position, taken along line C-C of FIG. 2, showing cam follower 6 mounted on cam follower mounting pin 13 in elongated body 2, and shuttle pads 8 in the locked position adjacent the cam follower 6.

FIG. 15 is a cross sectional view of switchable roller finger follower 1 in the unlocked position, taken along line C-C of FIG. 10, showing the features of FIG. 7, instead with shuttle pads 8 moved rearward and not visible at the point cross section C-C is taken.

FIG. 16 is a front view of switchable roller finger follower 1 in the unlocked position, taken from the valve end 4, showing the same features as FIG. 8, except with locking pin 16 absent as locking pin 16 is in a retracted position.

The manner in which a high lift operation of an associated valve system is performed according to an example aspect of the invention will now be described. When hydraulic fluid, normally engine oil, is supplied through hydraulic supply channel 18 into locking pin recess 17 and against locking pin base 20, pressure is exerted over the area of locking pin base 20, pushing locking pin 16 vertically upward. In turn, compressed lost motion springs 10 exert force against extension arms 9 of shuttle pads 8, pushing extension arms 9 forward into position adjacent cam follower 6. As shuttle pad base 12 moves forward of the top planar surface of locking pin 16, locking pin 16 extends vertically, locking shuttle pad base 12 of shuttle pads 8 into position adjacent cam follower 6. An associated multi-lobe camshaft (not shown) known in the art, rotates cam lobes into and out of contact with switchable roller finger follower 1. A larger cam lobe (not shown) of the multi-lobe camshaft (not shown) contacts shuttle pads 8, pushing downwardly, effecting a similar downward compression on an associated valve stem (not shown) seated in valve stem seat 15 thus enabling an associated valve (not shown) to lift away from a surface of an associated cylinder head of an internal combustion engine (not shown) in a high lift operation.

The manner in which a low lift operation of an associated valve system is performed according to an example aspect of the invention will now be described. When hydraulic fluid, commonly engine oil, is exhausted through hydraulic supply channel 18 away from locking pin recess 17 and locking pin base 20, pressure is removed from locking pin base 20, allowing locking pin 16 to recede toward the bottom surface of locking pin recess 17. When locking pin 16 is removed from contact with shuttle pad base 12, shuttle pad base 12 is pushed rearward by force exerted by gravity and by force exerted against associated shuttle pads 8 by associated cam lobes (not shown). As shuttle pads 8 are pushed rearward, associated extension arms 9 in contact with lost motion springs 10 slide along vertical slots 7, compressing lost motion springs 10. As force is removed from shuttle pads 8, compressed lost motion spring 10 exerts opposing force against extension arms 9, pushing extension arms 9 and associated shuttle pads 8 toward cam follower 6, coming into contact with rotating cam lobes (not shown) effecting lost motion movement of shuttle pads 8. As shuttle pads 8 are pushed rearward by a larger cam lobe of an associated multi-lobe camshaft (not shown), a smaller cam lobe (not shown) contacts cam follower 6, exerting force against cam follower 6 and associated roller finger follower 1, causing roller finger follower assembly 1 to move downwardly, in turn pushing an associated valve stem (not shown) seated in valve stein seat 15 thus enabling an associated valve (not shown) to lift away from a surface of an associated cylinder head of an internal combustion engine (not shown) in a low lift operation.

In the foregoing description, example embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of example embodiments described herein is sufficiently flexible and configurable, such that it may be utilized (and navigated) in ways other than that shown in the accompanying figures.

Although example embodiments have been described herein, many additional modifications and variations would be apparent to those skilled in the art. It is therefore to be understood that this invention may be practiced otherwise than as specifically described. Thus, the present example embodiments should be considered in all respects as illustrative and not restrictive.

LIST OF REFERENCE SYMBOLS

1 Switchable Roller Finger Follower Assembly
2 Elongated Body
3 Lash Adjuster End
4 Valve End
5 Elongated Body Side Walls
6 Cam Follower
7 Vertical Slot
8 Shuttle Pad
9 Extension Arm
10 Lost Motion Spring
11 Locking Pin Assembly
12 Shuttle Pad Base
13 Cam Follower Mounting Pin
14 Guide Wall
15 Valve Stem Seat
16 Locking Pin
17 Locking Pin Recess
18 Hydraulic Supply Channel
19 Lash Adjuster Seat
20 Locking Pin Base

The invention claimed is:

1. A switchable roller finger follower assembly for a valvetrain system, comprising:

an elongated body having a lash adjuster end, a valve stem end and at least two outer elongated side walls extending between the lash adjuster end and the valve stem end, a cam follower positioned in said elongated body mounted between the two outer elongated side walls;

at least one vertical slot positioned on a top edge of at least one of said elongated body side walls, at least one horizontally moveable lockable shuttle pad positioned on at least one side wall of said elongated body, the shuttle pad having at least one downward extension arm extending into the vertical slot for guiding and limiting the horizontal movement of the shuttle pad on the at least one outer elongated side wall, at least one lost motion spring positioned in said vertical slot, in contact with said extension arms of said shuttle pad, horizontally urging said at least one shuttle pad toward said cam follower, and at least one locking assembly operable to selectively lock said pad in locked position to effect one or more selected ones of plural lift operations.

2. The switchable roller finger follower assembly of claim 1, wherein, said elongated side walls include vertically integrally formed horizontal guides for said shuttle pad.

3. The switchable roller finger follower assembly of claim 1, wherein, said elongated body is formed of sheet metal.

4. The switchable roller finger follower assembly of claim 1, wherein, said elongated body is cast.

5. The switchable roller finger follower assembly of claim 1, wherein, said at least one vertical slot is grooved to contour with a mating groove in said at least one extension arm of said shuttle pad.

6. The switchable roller finger follower assembly of claim 1, wherein said at least one lost motion spring is a helical spring.

7. The switchable roller finger follower assembly of claim 1, wherein said at least one lost motion spring is a torsional spring.

8. The switchable roller finger follower assembly of claim 1, wherein said at least one lost motion spring is a torsional spring positioned on the outside of said elongated body.

9. The switchable roller finger follower assembly of claim 1, wherein, said locking assembly comprises a hydraulically actuated locking pin.

10. A method of operating a finger follower assembly, the method comprising:

exerting force to the finger follower assembly, the assembly comprising an elongated body having at least two side walls, a cam follower positioned in said elongated body, a locking pin, at least one lost motion spring, and at least one shuttle pad horizontally moveably positioned on at least one side wall of said elongated body, and selectively locking or unlocking the at least one shuttle pad, to effect one or more selected ones of plural lift operations, in response to the force being exerted to the finger follower assembly.

11. The method of claim 10, wherein the selectively locking comprises providing hydraulic fluid to the locking pin, the locking pin engaging the at least one shuttle pad to maintain the position of the shuttle pad adjacent the cam follower, to effect a high lift operation in response to the force being exerted to the finger follower assembly.

12. The method of claim 10, wherein the selectively unlocking comprises exhausting hydraulic fluid from the locking pin, the locking pin disengaging from the at least one shuttle pad so that gravity and the force being exerted to the finger follower assembly moves the shuttle pad against the at least one lost motion spring, to effect lost motion movement of the at least one shuttle pad and, in turn, to effect a low lift operation in response to the force being exerted to the finger follower assembly.

13. The method of claim 10, wherein the exerting comprises engaging at least one of the shuttle pad and cam follower with at least one cam lobe of a camshaft.

14. The method of claim 10, wherein the at least one cam lobe includes plural cam lobes having different cam profiles, and wherein the engaging includes engaging the cam follower with at least a first one of the cam lobes and engaging the at least one shuttle pad with at least a second one of the cam lobes.

15. The method of claim 10, wherein the lift operations operate a valve system.

* * * * *